US006751886B2

(12) United States Patent
Chang et al.

(10) Patent No.: US 6,751,886 B2
(45) Date of Patent: Jun. 22, 2004

(54) DEVICE FOR INTRODUCTION OF A SUBSTANCE INTO A PROPELLED FLUID

(75) Inventors: Timothy Chang, Wayne, NJ (US); Sherwood Forlee, Davis, CA (US); Eugene Hans Kung, Mount Vernon, NY (US); Kaijen Hsiao, Waltham, MA (US); Flavio Poehlmann-Martins, Media, PA (US)

(73) Assignee: Vivrant, L.L.C., Princeton, NJ (US)

( * ) Notice: Subject to any disclaimer, the term of this patent is extended or adjusted under 35 U.S.C. 154(b) by 0 days.

(21) Appl. No.: 10/354,873

(22) Filed: Jan. 30, 2003

(65) Prior Publication Data

US 2003/0150126 A1 Aug. 14, 2003

Related U.S. Application Data

(60) Provisional application No. 60/356,433, filed on Feb. 12, 2002.

(51) Int. Cl.[7] ..... A45D 20/00

(52) U.S. Cl. ..... 34/96; 34/97

(58) Field of Search ..... 34/96, 97, 90, 34/60; 132/271, 272; 392/380, 383, 385; D28/13, 18

(56) References Cited

U.S. PATENT DOCUMENTS

| | | | | | |
|---|---|---|---|---|---|
| 1,727,212 | A | | 9/1929 | Martin | 392/379 |
| 3,575,181 | A | * | 4/1971 | Rudd | 132/272 |
| 3,721,250 | A | * | 3/1973 | Walter et al. | 132/112 |
| 3,800,810 | A | * | 4/1974 | Mercer | 132/272 |
| 3,947,659 | A | * | 3/1976 | Ono | 392/404 |
| 4,166,473 | A | * | 9/1979 | Bauer et al. | 132/272 |
| 4,195,416 | A | | 4/1980 | Hall | 34/90 |
| 4,383,377 | A | | 5/1983 | Crafton | 34/60 |
| 4,523,080 | A | | 6/1985 | Bolton | 219/362 |
| 4,597,191 | A | * | 7/1986 | Juzefczyk | 34/60 |
| 4,605,019 | A | * | 8/1986 | Reynolds et al. | 132/272 |
| 4,632,133 | A | * | 12/1986 | Losenno | 132/231 |
| 4,835,879 | A | | 6/1989 | Egelstad | 34/97 |
| 5,241,974 | A | | 9/1993 | Tsai | 132/272 |
| 5,261,426 | A | | 11/1993 | Kellett et al. | 132/272 |
| 5,339,540 | A | * | 8/1994 | Edwards | 34/97 |
| 5,490,336 | A | | 2/1996 | Smick et al. | 34/97 |
| 5,514,346 | A | | 5/1996 | Fujita | 422/124 |
| 5,572,800 | A | | 11/1996 | West | 34/97 |
| 5,841,943 | A | | 11/1998 | Nosenchuck | 392/385 |
| 5,987,771 | A | | 11/1999 | Curtin | 34/97 |
| 2002/0053351 | A1 | * | 5/2002 | Mugge et al. | 132/272 |

* cited by examiner

*Primary Examiner*—Henry Bennett
*Assistant Examiner*—Andrea M. Ragonese
(74) *Attorney, Agent, or Firm*—David M. Quinlan, P.C.

(57) ABSTRACT

An apparatus comprises a duct having a fluid outlet for fluid propelled through the duct and a container positions a substance for diffusion into the fluid through an opening. A movable valve selectively places the opening in fluid communication with the fluid in the duct and seals the opening to prevent introduction of the substance into the fluid. In a particularly advantageous embodiment the apparatus is a blow dryer in which a heating element disposed in the duct heats air flowing therethrough. The substance can be a fragrance or a conditioner introduced into the air stream. According to other aspects of the invention, the container is interchangeable with containers containing other substances, such as different fragrances, and is completely sealed when the blow dryer is not in use. In another embodiment, a container attached to the duct ejects the substance in a spray external of the duct proximate to the duct outlet. In a particularly preferred form of that embodiment, the spray cartridge is interchangeable with a diffusion cartridge.

19 Claims, 9 Drawing Sheets

FIG. 1
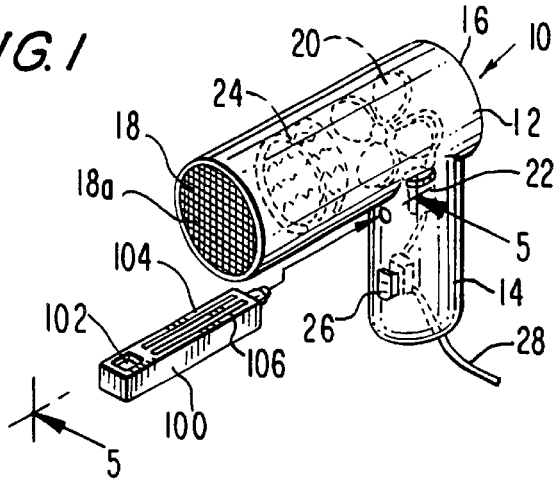
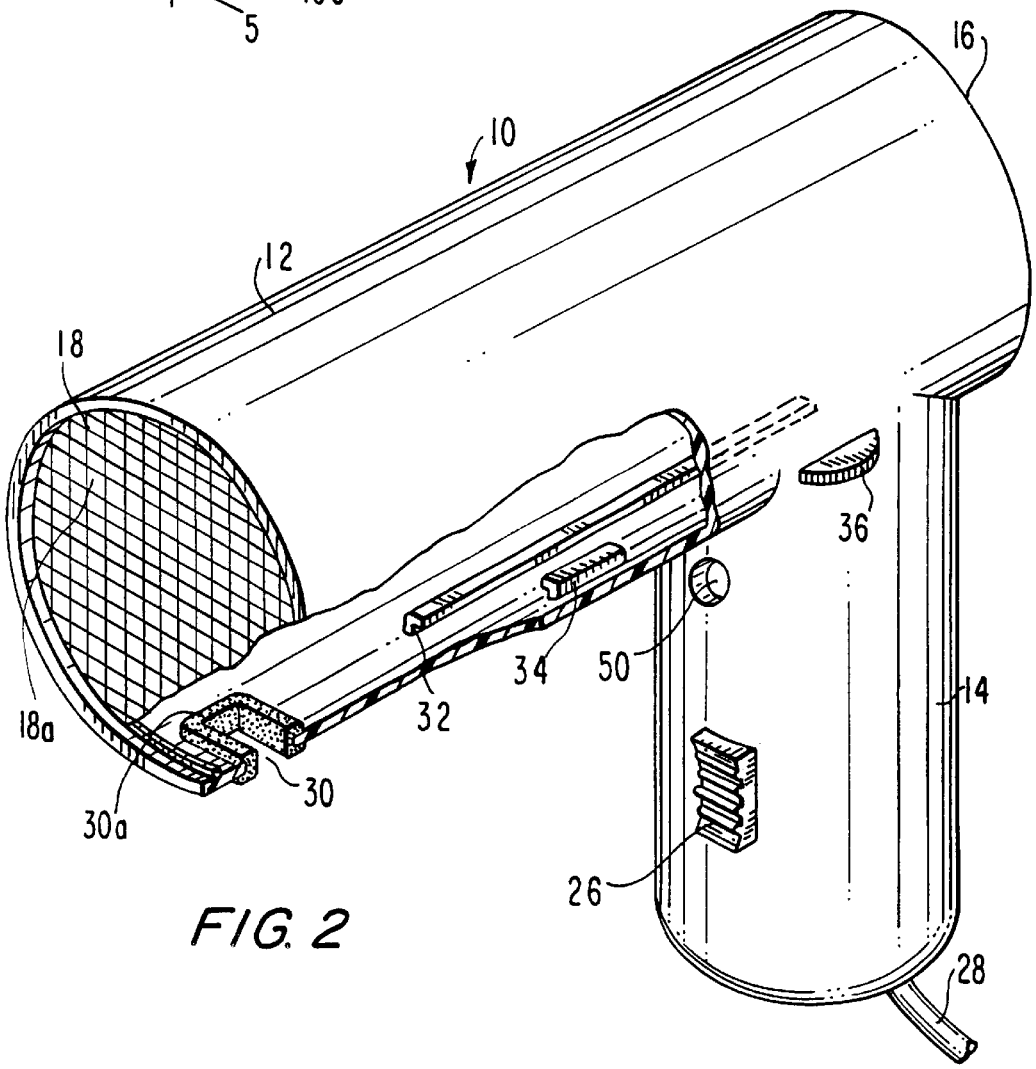
FIG. 2

52
52a
160
156
36
26a
26b
26
10
150
152
154
12
30
30a
A
B

DEVICE FOR INTRODUCTION OF A SUBSTANCE INTO A PROPELLED FLUID

CROSS-REFERENCE TO RELATED APPLICATIONS

This application claims the benefit of U.S. provisional application No. 60/356,433, filed Feb. 12, 2002.

BACKGROUND OF THE INVENTION

1. Field of the Invention

The present invention relates to dispensing apparatus, and more particularly, to apparatus for dispensing a substance in connection with an impelled fluid.

2. Description of Related Art

There are numerous prior art devices that introduce substances into a fluid stream propelled through a duct. Common such devices are hair, hand, or clothes dryers, or room fresheners, in which fragrances, conditioners, deodorants, disinfectants, or the like, are introduced onto the air stream expelled from the device. Specific examples of such devices are shown in U.S. Pat. No. 1,727,212 to Martin, U.S. Pat. No. 4,195,416 to Hall, U.S. Pat. No. 4,383,377 to Crafton, U.S. Pat. No. 4,523,080 to Bolton, U.S. Pat. No. 4,835,879 to Egelstad, U.S. Pat. No. 5,241,974 to Tsai, U.S. Pat. No. 5,490,336 to Smick et al., U.S. Pat. No. 5,514,346 to Fujita, U.S. Pat. No. 5,572,800 to West, and U.S. Pat. No. 5,987,771 to Curtin.

Most of the devices shown in these patents provide for the diffusion of a volatile substance into a heated air stream. While they appear to be capable of performing that function with varying degrees of effectiveness, none of them enables the substance to be cut off from fluid communication with the air stream or ambient atmosphere when desired. Accordingly, the substance can evaporate and be introduced into the ambient atmosphere even when the device is not being used, which means that the substance will require replacement more often than is necessary. And since most of the substances contemplated for use with such devices have a distinctive fragrance, the device will create an unavoidable lingering aroma during use and storage. U.S. Pat. No. 5,572,800 to West incorporates an adjusting ring for changing the degree to which scent strips are exposed to a heated air stream flowing through the hair dryer duct, and the patent asserts that the scent strips can be sealed off from the air flow in the duct. However, a close examination of the patent disclosure reveals that the scent strips in fact remain in fluid communication with the air stream and the ambient atmosphere through apertures in the duct wall, even when the adjusting ring is in its ostensibly closed position.

U.S. Pat. No. 4,523,080 to Bolton discloses another method for introducing a substance such as a conditioner into the air stream exiting a hair dryer. A conventional aerosol spray can is mounted on the hair dryer, which has a trigger that acts through a linkage to depress the activating button on the aerosol can. However, the spray is introduced upstream of the hair dryer impeller and heating element, thus providing the opportunity for befouling those dryer components and reducing the concentration of the conditioner before it reaches the user's hair. In addition, the aerosol can protrudes from the hair dryer in a fashion that makes it awkward for the user to manipulate the dryer while drying his or her hair.

SUMMARY OF THE INVENTION

It is an object of the present invention to provide an apparatus that permits dispensing of a substance in connection with an impelled fluid stream in a manner that overcomes the disadvantages of the prior art.

It is another object of the invention to provide a blower device that can introduce a volatile substance into an air stream by diffusion and can substantially prevent diffusion of the substance into the air stream and/or ambient atmosphere when so desired.

It is yet another object of the invention to provide an apparatus with a cartridge that can spray a substance proximate to the outlet of a duct carrying impelled fluid.

In accordance with one embodiment of the invention, an apparatus comprises a duct with an outlet for fluid impelled internally through the duct, a container for holding a substance, the container having an opening and being constructed for mounting to the apparatus with the opening positioned for fluid communication internally of the duct, and a valve movable between an open position for placing the opening in fluid communication with the fluid in the duct to permit introduction of the substance into the fluid and a closed position for sealing the opening.

In accordance with another embodiment of the invention, a hair dryer comprises a duct with an air outlet, an impeller for propelling air internally through the duct to exit therefrom at the outlet, a heating element in the duct for heating the air propelled therethrough, a containing member mounted to the duct to position a substance for fluid communication internally of the duct through an aperture in the duct, and a valve movable between an open position for placing the substance in fluid communication with the air in the duct through the aperture to permit introduction of the substance into the air and a closed position for sealing the aperture.

In accordance with yet another embodiment of the invention, a blow dryer comprises a duct having an air outlet, an impeller for propelling air internally through the duct to exit therefrom at the outlet, a heating element in the duct for heating the air propelled therethrough, a container for holding a substance, the container being constructed for mounting to the duct with the substance positioned for fluid communication internally of the duct through an opening in the container, and a valve movable between an open position for placing the opening in fluid communication with the air in the duct to permit introduction of the substance into the air and a closed position for sealing the opening.

A particular advantage of the invention is its ability to prevent evaporation and diffusion of the substance into the ambient atmosphere when the valve is in the closed position. This is important not only because it preserves the substance, but also because a user will be able to detect the presence of very small amounts of a fragrant substance if it is exposed to the ambient atmosphere.

In another aspect, the invention includes a cartridge for holding a liquid substance for introduction into an air stream exiting a blow dryer, which cartridge comprises a pump mechanism for expelling the liquid substance as a spray of fine droplets from an aerosol nozzle, manual actuating means for operating the pump mechanism to cause the spray of droplets to exit the nozzle, and a mounting arrangement for mounting the cartridge to the blow dryer with the nozzle proximate to an outlet of a dryer duct expelling the air stream.

Yet another aspect of the invention involves a system for introducing substances into an air stream exiting a blow dryer, which system comprises a blow dryer having a duct with an air outlet and an aperture in a wall of the duct, an impeller for propelling air internally through the duct to exit therefrom at the outlet, and a heating element in the duct for heating the air propelled therethrough; a first self-contained cartridge for holding a substance and having a fastener for cooperating with a mounting arrangement on the blow dryer for removably mounting the first cartridge to the blow dryer with an opening in the cartridge aligned with the aperture to enable fluid communication of the substance internally of the duct through the aperture and the opening, wherein the blow dryer includes a user-controlled valve mechanism movable between an open position for uncovering the aperture to place the opening in fluid communication with the air in the duct to permit introduction of the substance into the air and a closed position for sealing the opening; and a second self-contained cartridge for holding a liquid substance and having a pump mechanism for expelling the liquid substance as a spray of fine droplets from an aerosol nozzle, actuating means for operating the pump mechanism to cause the spray of droplets to exit the nozzle, and a fastener for cooperating with the mounting arrangement for mounting the second cartridge to the blow dryer with the nozzle proximate to the outlet and with the actuating means positioned for operation by the valve mechanism.

The invention in all of its aspects facilitates manufacture of apparatus that embodies the invention's advantageous features, and the invention can be implemented without affecting the performance of the apparatus. The invention also can be realized in ways that facilitate use of the apparatus and enable replenishment of the substance introduced into or in connection with the impelled fluid stream.

BRIEF DESCRIPTION OF THE DRAWINGS

The objects of the invention will be better understood from the detailed description of its preferred embodiments which follows below, when taken in conjunction with the accompanying drawings, in which like numerals refer to like features throughout.

The following is a brief identification of the drawing figures used in the accompanying detailed description.

FIG. 1 is an exploded perspective view of a hair dryer and a cartridge for a volatile substance to be introduced into the heated air stream within the hair dryer, in accordance with a first aspect of the present invention.

FIG. 2 is an enlarged perspective view of the hair dryer shown in FIG. 1 with the cartridge omitted for clarity and with part of the hair dryer duct cut away to show an aperture through which the substance in the cartridge is introduced into the air stream.

DETAILED DESCRIPTION OF THE PREFERRED EMBODIMENTS

Figure 3:
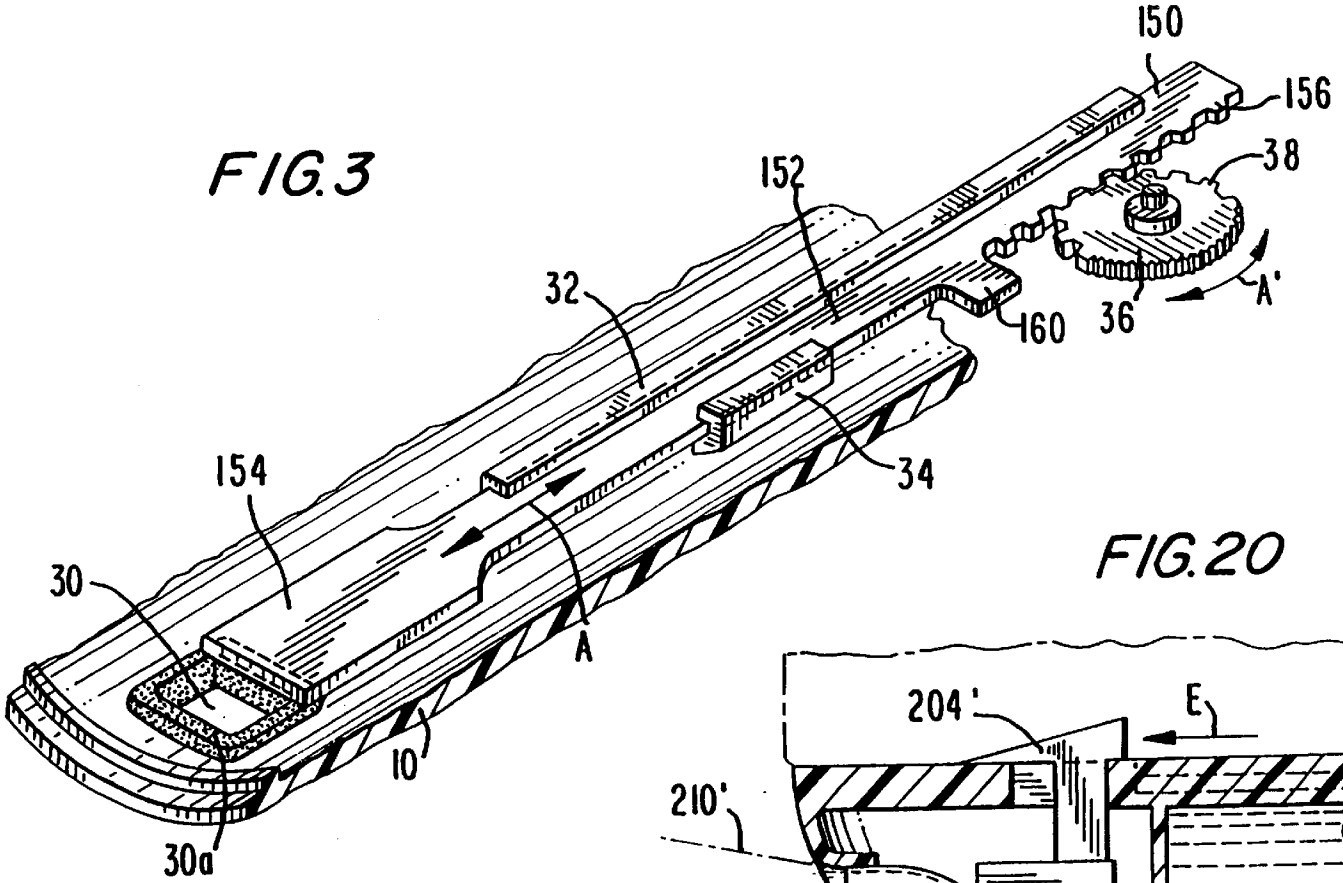
FIG. 3 is an enlarged perspective view of a valve for controlling the degree to which the substance in the cartridge shown in FIG. 1 is introduced into the hair dryer air stream.

FIG. 1 is an exploded perspective view of a hair dryer 10 incorporating the present invention. It should be understood that the invention is described in connection with a hair dryer of the depicted configuration for convenience only. As will become apparent as this description proceeds, and as discussed in more detail later, the invention is applicable to apparatus with purposes other than drying human hair. The hair dryer 10 in FIG. 1 includes an air duct 12 to which is connected a handle 14 for manipulating the hair dryer to direct a stream of heated air onto the user's hair. To that purpose the air duct has an inlet 16 and an outlet 18, between which, in conventional fashion, are disposed an impeller such as an axial flow fan 20, driven by a motor 22, and a heating element 24. A protective screen 18*a* is typically provided over the outlet 18 to prevent ingress into the duct of foreign objects (the user's hair, fingers, etc.). A similar screen (not shown) covers the duct inlet 16. A power switch 26 on the handle 14 controls the electrical power supplied from the power cord 28 to the motor 22 and the heating element 24.

The features described thus far are conventional in known hair dryers. Those familiar with this art will understand that other hair dryer configurations can be used with the present invention as described herein. For example, the invention is readily incorporated into a hair dryer of the type that uses a so-called "squirrel cage" impeller, or a centrifugal impeller connected to a duct, as shown, for example, in the above-mentioned U.S. patent to Egelstad. It can also be used with a hair dryer having multiple impellers, such as shown in U.S. Pat. No. 5,841,943 to Nosenchuck. In other words, the invention can be incorporated in any conventional blow dryer, regardless of its construction.

FIG. 1 also shows a cartridge 100 that is removably attachable to the hair dryer 10 in a manner described in detail below. FIG. 2 depicts the hair dryer 10 enlarged from the scale shown in FIG. 1, with part of the duct cut away to illustrate how the substance in the cartridge 100 (omitted from FIG. 2 for clarity) is placed in fluid communication with the air propelled through the duct 12 by the fan 20. To that end, an aperture 30 is formed in the duct wall for mating with a cooperating diffusion opening 102 in the cartridge when the latter is mounted on the hair dryer. The inside of the duct wall also includes slider guides 32 and 34, and a knurled actuator wheel 36 is rotatably mounted to the hair dryer to protrude from the hair dryer handle 14, all for purposes to be described next.

FIG. 3 depicts a valve 150 that controls the degree to which the substance in the cartridge 100 is permitted to diffuse into the duct. The valve 150 includes a slider portion 152, with a wider sealing portion 154 at its proximal end. The slider portion 152 is held between the slider guides 32 and 34 to permit the valve plate to move in the directions of the double headed arrow A in FIG. 3. (The valve 150 is omitted from FIG. 2 in order to depict the slider guides 32 and 34 more clearly.) The distal end of the slider plate has a rack gear 156 on one edge thereof. The rack gear 156 meshes with gear teeth 38 formed partially around the edge of the actuator wheel 36 so that rotation of the wheel 36 in the directions of the double headed arrow A' causes the valve 150 to move in the respective directions of the arrow A.

Figure 4:
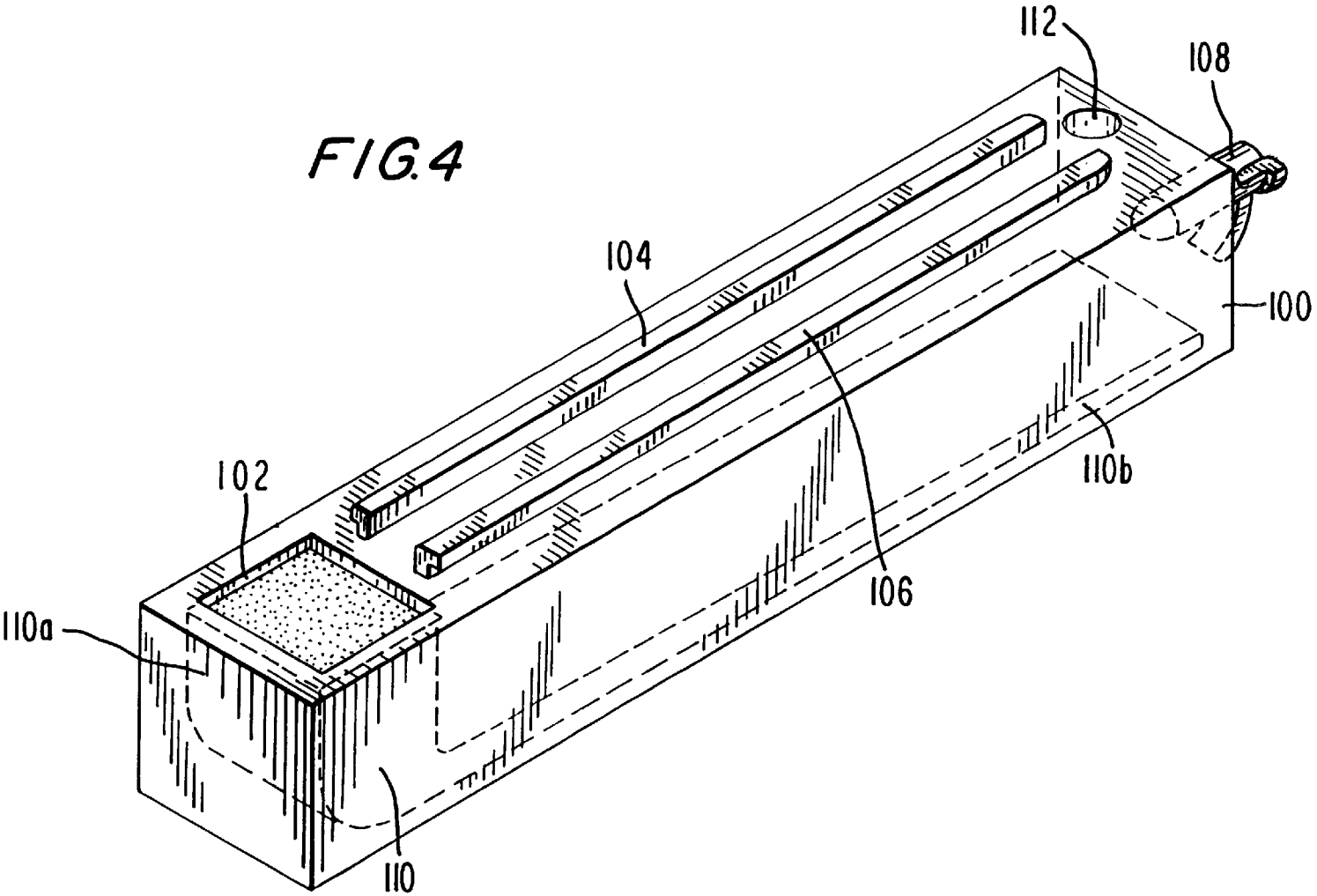
FIG. 4 is an enlarged perspective view of the cartridge shown in FIG. 1.

FIG. 4 is a detailed view of the cartridge 100. As noted above, it includes a diffusion opening 102 that cooperates with the aperture 30 in the hair dryer duct 12 when the cartridge is mounted on the hair dryer 10. To effect such mounting, the cartridge includes a fastener that comprises mounting rails 104 and 106 which extend along the cartridge longitudinally thereof, and a clip 108 which latches the cartridge 100 to the hair dryer, in a manner described below in connection with FIGS. 5 to 7. The cartridge 100 is sealed except for the opening 102, and has disposed therein a wicking member 110 with a columnar portion 110*a*, which fits snugly against the inside of the cartridge 100 at the opening 102, and an integral tail portion 110*b*. The cartridge 100 is filled with a liquid substance S (see FIGS. 5–7 also) that enables it to evaporate and diffuse through the opening 102. The columnar portion 110*a* covers the opening 102 and the tail portion 110*b* lines the bottom inside of the cartridge so that a portion of the wicking member 110 always remains in contact with the liquid when the hair dryer is in its normal orientation. (It should be understood that positional terms such as "bottom" and "top," "up" and "down," etc., are used throughout solely for purposes of description. They refer to directions or positions in a normal orientation, and are not intended to be limiting as to the operation or configuration of the invention.) In this manner the columnar portion 110*a* is maintained saturated with the liquid substance S to promote its diffusion through the opening 102.

The liquid substance S can be a perfume or a hair conditioner, or any other substance suitable or desirable for introduction into the hair dryer air stream. The wicking member 110 is chosen in consideration of the surface tension of the substance so that it will be held within the wicking member regardless of the orientation of the cartridge 100. The wicking member 110 can be any suitable porous material, preferably a synthetic sponge-like material, having a pore size chosen to provide sufficient capillary action to maintain saturation thereof by the liquid substance S. A suitable removable cover (not shown) may be provided by the opening 102 to prevent evaporation of the liquid substance during transport of the cartridge or when the cartridge is otherwise not mounted in place on the hair dryer.

Those skilled in the art will also recognize that it is not necessary that the substance to be introduced into the air stream be a liquid. The invention contemplates using a solid substance as well, but a liquid is advantageous because it is more readily replaced when used up. That is, the cartridge can include a fill port 112 with a removable closure through which depleted liquid can be replaced. In another advantageous embodiment, the cartridge can be made of a transparent or translucent plastic material that permits a user to see at a glance how much of the substance remains in the cartridge. Alternatively, the cartridge can be made of an opaque substance and be provided with a view port to permit the user to determine the amount of substance remaining.

Figure 5:
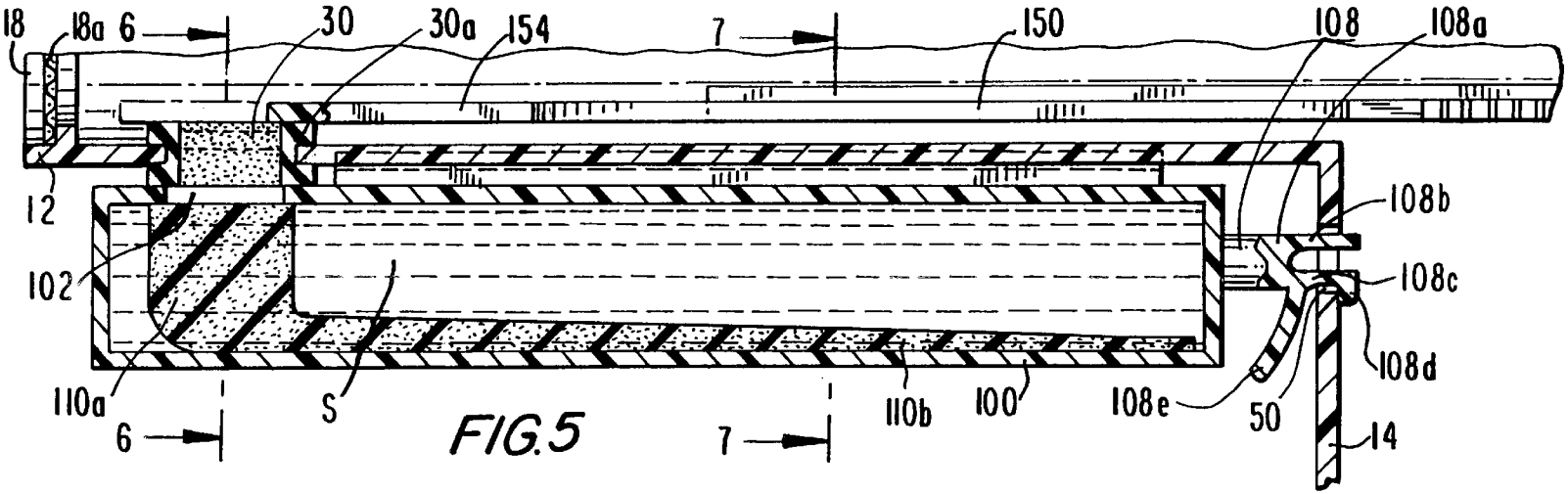
FIG. 5, when taken with FIGS. 6 and 7, illustrates the manner of mounting the cartridge depicted in FIG. 4 to the hair dryer, with FIG. 5 being a cross-section of the cartridge and the hair dryer taken at lines 5—5 in FIG. 1.
Figure 7:
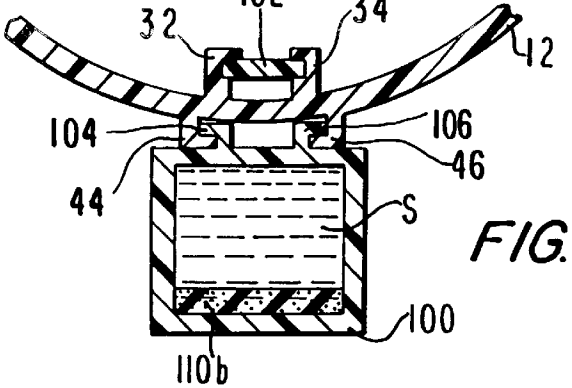
FIG. 7 is a cross-section taken at lines 7—7 in FIG. 5.
Figure 6:
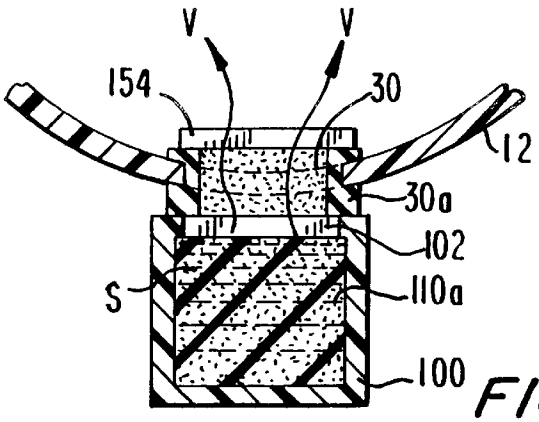
FIG. 6 is a cross-section taken at lines 6—6 in FIG. 5.

FIGS. 5 to 7 illustrate the manner in which the cartridge mounts to the hair dryer in the present embodiment. The hair dryer duct 12 includes a pair of mounting rails 44 and 46 that accept the cartridge mounting rails 104 and 106, respectively. As seen in FIG. 1, the cartridge 100 slides axially along the outside of the hair dryer duct wall to mount it to the hair dryer. FIG. 5 shows the cartridge 100 latched in place on the hair dryer duct 12 by the clip 108. The clip includes a split post 108*a* forming a top finger 108*b* and a bottom finger 108*c*. The bottom finger includes a flange 108*d* that snaps into place in a latch that comprises a through hole 50 in the dryer handle 14. The clip 108 is formed with an integral release lever 108*e*, which, when depressed, deforms the bottom finger 108*c* and moves the flange 108*d* out of engagement with the edge of the hole 50. The cartridge 100 can then be removed from the hair dryer by sliding it along the dryer mounting rails 44 and 46 in the direction opposite to the mounting direction.

FIGS. 5 to 7 also illustrate another important feature of the present invention. The aperture 30 includes a rubber sealing grommet 30*a* completely surrounding the aperture and extending slightly internally and externally of the hair dryer duct 12. The periphery of the grommet presents a substantially planar internal sealing surface inside of the hair dryer duct and a substantially planar external sealing surface outside the hair dryer duct. The slider portion 152 of the valve 150 is positioned by the slider guides 32 and 34 (see FIG. 7) so that in its closed position the valve sealing portion 154 will fit snugly on top of the internal sealing surface of the grommet 30*a* (see FIGS. 5 and 6). Likewise, duct mounting rails 44 and 46 cooperate with the cartridge mounting rails 104 and 106 to position the cartridge 100 so that it fits snugly against the external sealing surface of the grommet 30*a* when the cartridge is mounted and latched in place on the hair dryer (see FIGS. 5 and 6). These sealing arrangements are exemplary only, and alternate arrangements are possible within the scope of the invention. For example, the valve can include a sealing portion that interlocks with structure associated with the dryer duct, or that forms a male/female fitting therewith, to ensure complete sealing of the cartridge contents.

The operation of the embodiment described thus far will be clear to those skilled in this art from the above description. Assuming that a cartridge with the desired substance is already mounted to the hair dryer, that the hair dryer is running, and that the valve is in its open position, as shown in FIG. 3 and in solid lines in FIG. 5, the user directs heated air from the hair dryer onto her hair, as she would do with any conventional hair dryer. The substance S in the cartridge is introduced as a vapor V (see FIG. 6) by diffusion through the opening 102 in the cartridge and in turn through the open aperture 30 in the hair dryer duct, and thus into the air stream being impelled through the hair dryer duct. If the substance S is a perfume, for example, it imparts a subtle fragrance to the user's hair. The user can control the amount of the substance introduced into the air stream using the actuator wheel 36. It is located conveniently on the hair dryer handle 14 (see FIG. 2) so that the user can turn it with his thumb while holding the hair dryer in its normal orientation. Turning the wheel 36 moves the valve 150 so that the sealing portion 154 covers more or less of the aperture 30. As noted above, the cartridge 100 may be constructed so that the user can tell how much substance remains in the cartridge and whether it needs to be refilled. In addition, the ease with which the cartridge can be mounted in place on and removed from the hair dryer makes it easy for the user to employ different cartridges containing different substances, such as a conditioner rather than a perfume. It also enables her to keep on hand and use different cartridges with different fragrances depending on a particular preference at one time or another. Of course, the invention contemplates using control mechanisms besides the depicted toothed wheel and rack gear arrangement. For example, the valve can include a handle that protrudes from the hair dryer, or a mechanical lever arrangement can be used to adjust the valve position.

Another advantage of the present invention is that it can be used with almost any type of existing hair dryer with very little modification of the hair dryer configuration. From a commercial standpoint this is significant because it does not require significant engineering effort or change in basic manufacturing procedures and tooling to incorporate the invention in an existing hair dryer design. In addition, embodiments of the invention in which the substance is introduced proximate to the dryer outlet, downstream of the heating element and impeller, maximize the effect of the substance and avoid fire hazards.

Another particularly important feature of the invention is the ability to seal the aperture 30 when desired. The valve 150 in its closed position seals the duct wall aperture 30 when the valve sealing portion 154 is in place over the aperture, as depicted in dotted lines in FIG. 5. This enables use of the hair dryer without unwanted introduction of the substance into the air stream, or into the ambient atmosphere where it can be detected by the user. The present embodiment is also advantageous because moving the valve to its closed position simultaneously seals the cartridge opening 102, which prevents evaporation of the substance S from the container when the hair dryer is not in use. In the present embodiment this is accomplished by the cooperating configuration of the grommet 30*a* and the structure mounting the cartridge and the valve to the hair dryer, as discussed above. However, those skilled in the art will appreciate that alternate constructions can achieve this result without departing from the present invention.

Figures 8, 9, 10:
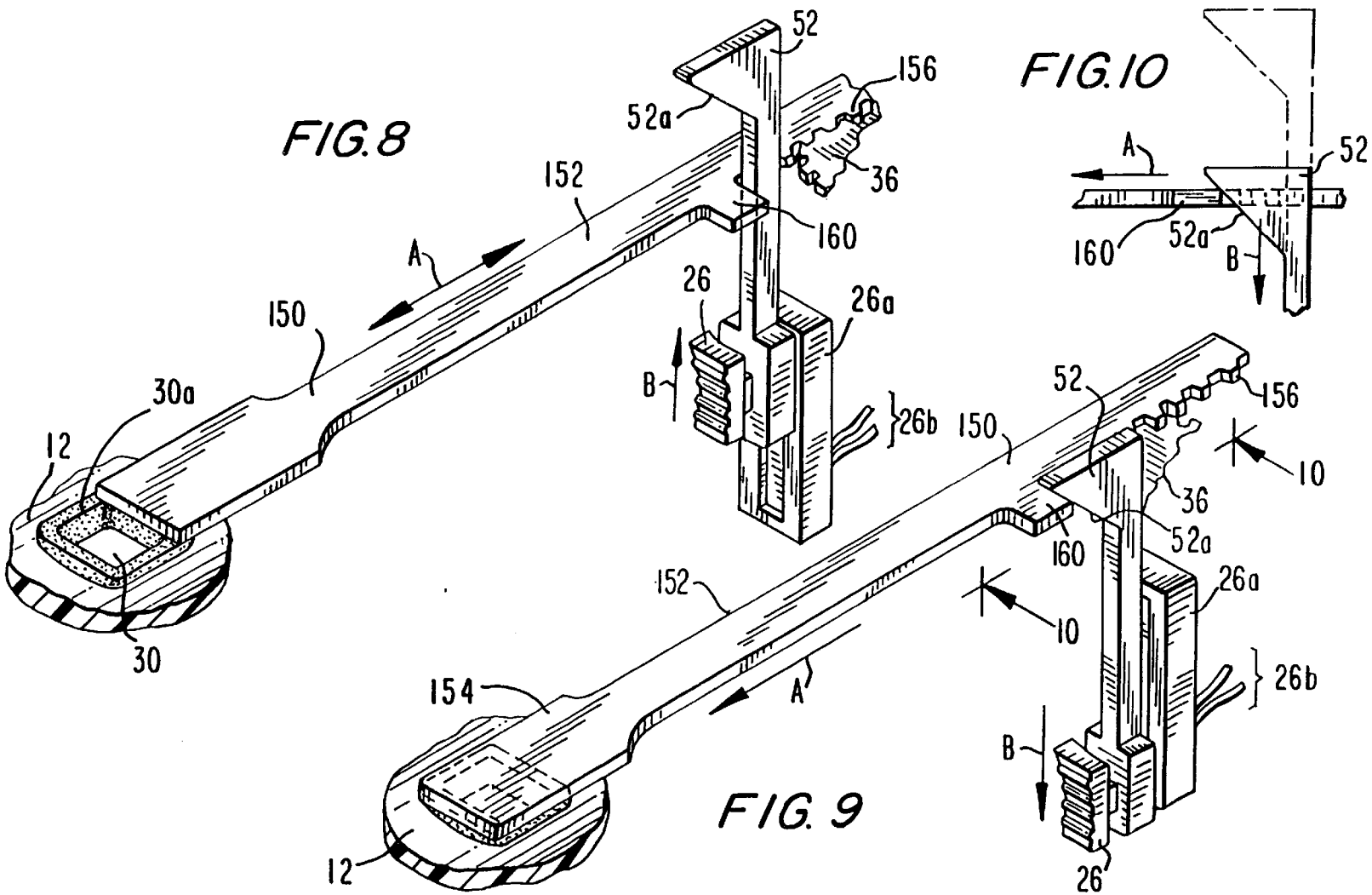
FIG. 8, when taken with FIGS. 9 and 10, illustrates an automatic shut-off mechanism for the valve depicted in FIG. 3, with FIG. 8 depicting a full-open position the valve can assume when the hair dryer is in use.
FIG. 9 depicts the automatic shut-off mechanism activated when the hair dryer power switch is moved to its OFF position.
FIG. 10 is a cross-section taken at lines 10—10 of FIG. 9.

FIGS. 8 to 10 illustrate another feature for which this embodiment of the invention is particularly adapted. FIG. 8 is a perspective view of an automatic shut-off mechanism for the valve 150. The slider portion 152 includes a camming lever 160 extending from the slider portion transverse to the direction of movement of the valve 150. A cam 52 with a sloped edge 52*a* is mounted for movement with the dryer power switch 26. In conventional fashion, the power switch controls electronic components 26*a* connected by wires 26*b* to the fan motor 22 and the heating element 24 to regulate the speed of the fan and the amount of heat energy imparted to the air stream flowing through the dryer duct 12. The switch slides up and down as suggested by the arrow B between an OFF position, at one extreme of the switch range of motion, and different power settings, such as the positions labeled LOW, MEDIUM, and HIGH. These different settings provide different current and voltage levels to the fan motor and heating element in a conventional manner.

When the power switch 26 is moved upward out of the OFF position, as shown by arrow B in FIG. 8, the cam 52 is moved away from the camming lever 160. This enables the user to adjust the position of the valve 150, and the valve sealing portion 154, as discussed above. This position of the cam 52 is shown in phantom lines in FIG. 10. However, when the switch 46 is moved to the OFF position, as shown by the arrow B in FIGS. 9 and 10, the sloped edge 52*a* on the bottom of the cam 52 forces the camming lever 160 in the direction of the arrow A in FIG. 9, thus moving the valve 150 to its closed position as discussed above. This cam position is depicted in solid lines in FIG. 10, and thus provides for an automatic positive close of the aperture 30 and the diffusion opening 102, as seen in FIG. 9. Accordingly, the contents of the cartridge are protected from evaporation even if the user forgets to use the actuator wheel 36 to close the aperture after using the hair dryer.

Figure 11:
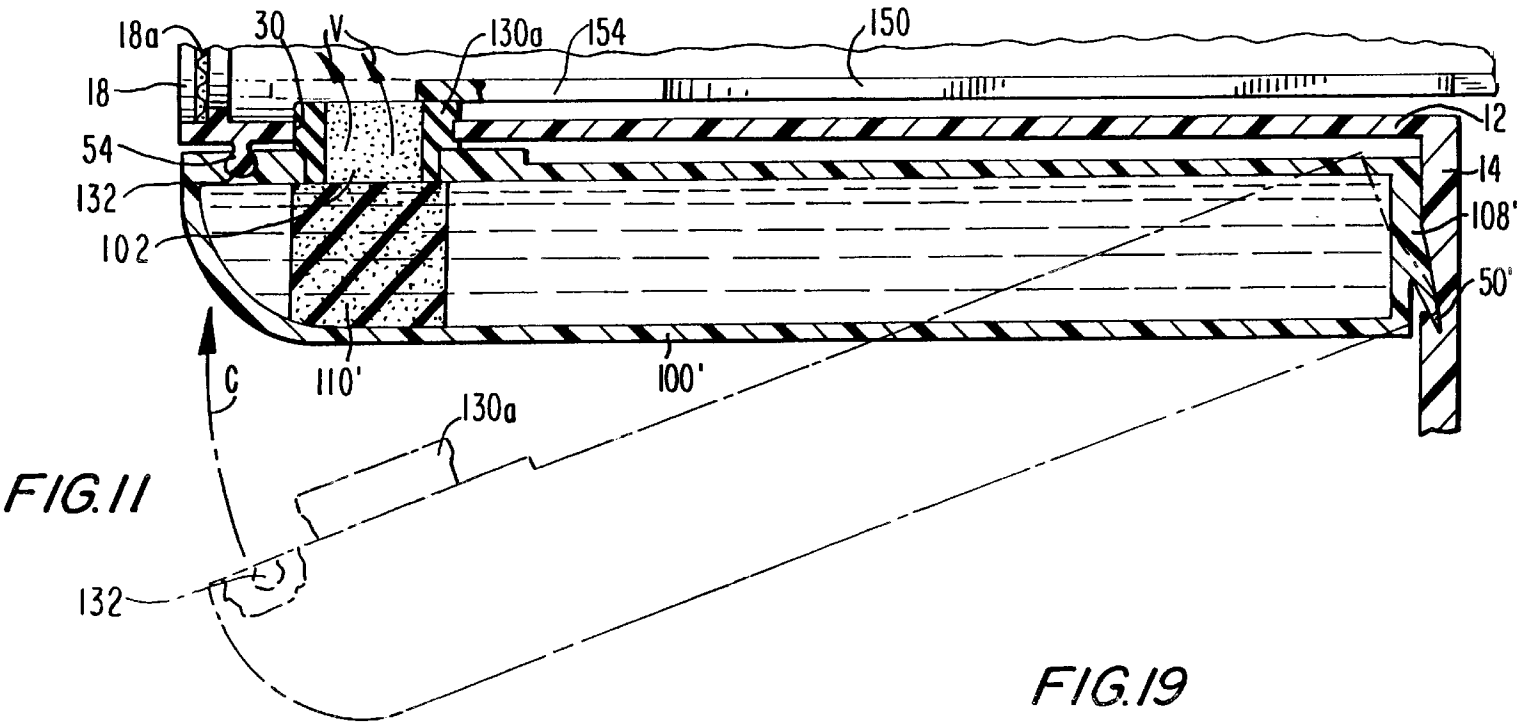
FIG. 11 is a sectional view of an alternate embodiment of the cartridge already shown, taken in the same general orientation as FIG. 5.

FIG. 11 depicts a cartridge 100' of alternate construction, thus illustrating that the invention is not dependent on the configuration of the cartridge for realization of its advantages. The cartridge 100', and the cooperating portion of the hair dryer duct, are shown in FIG. 11 in the same general orientation as FIG. 5. Features in FIG. 11 that correspond to features in the previous embodiment, either by general function or configuration, are denoted with a prime (′). The cartridge 100' differs from the cartridge 100 in several respects. First, the cartridge 100' includes a sealing grommet 130*a* that is secured to the interior periphery of the diffusion opening 102. When the cartridge is in place on the hair dryer, as shown in solid lines in FIG. 11, the sealing grommet 130*a* extends through the aperture 30 in the hair dryer duct with a slight interference fit. This provides a positive seal between the interior of the cartridge 100' and the interior of the hair dryer duct 12. The portion of the grommet 130*a* that extends inside the dryer duct presents an internal sealing surface like that presented by the grommet 30*a* in the above embodiment.

Next, the cartridge 100' is secured to the hair dryer in a different fashion from the previous embodiment. A clip in the form of a small tongue 108' extending slightly obliquely from the rear end of the cartridge fits into a latch in the form of a blind slot 50' in the hair dryer handle 14. The cartridge 100' is mounted to the hair dryer by hooking the tongue 108' into the slot 50', thus placing the cartridge 100' in the position shown in phantom lines in FIG. 11, and then swinging upward along an arc denoted by the arrow C in FIG. 11. The front end of the cartridge includes a small blind hole 132 that has an opening at the cartridge surface slightly smaller than the interior bore size of the hole. The hole 132 snaps onto a small knob 54 on the hair dryer duct, which knob is slightly larger in diameter than the opening to the blind hole, but fits within the bore thereof. Accordingly, the knob 54 grasps the blind hole 132 by virtue of the friction between them to hold the cartridge 100' in place on the hair dryer. The cartridge can be positioned laterally relative to the hair dryer duct by a groove (not shown) that fits over a ridge (not shown) running axially along the dryer duct 12.

Other differences between this and the previous embodiment reside in the configuration of a wicking member 110' that comprises only a member similar to the columnar portion 110*a* of the previous embodiment, thus illustrating the optional nature of the configuration of the wicking member. Other configurations are also possible within the scope of the present invention. For example, the wicking member can substantially fill the entire cartridge.

FIGS. 12 to 15 illustrate a cartridge 100" of still another construction; in this embodiment features that generally correspond to features previously discussed are denoted with a double prime (″). The cartridge 100" is similar to the cartridge 100 shown in FIGS. 5 to 7, except that its shape is more rounded and it mounts to the hair dryer duct in a slightly different fashion. The cartridge 100" includes mounting rails 104" and 106" that correspond to their counterparts in cartridge 100. However, the mounting rails 104" and 106" are recessed into the top surface of the cartridge 100", thus giving it a more streamlined appearance. The mounting rails 104" and 106" permit the cartridge 100" to slide axially along the outside of the hair dryer duct wall on the mounting rails 44 and 46, as described above in connection with FIGS. 5 to 7. A protrusion 138 molded into the top of the cartridge 100" slides into a cooperating depression (not shown) in the dryer duct wall to provide a detent mechanism that holds the cartridge 100" in place. Those skilled in the art will understand that the height of the protrusion 138 will have to account for the extent to which the grommet 30*a* extends outwardly from the dryer duct wall. The "cleaner" look of the cartridge 100" illustrates the versatility of the present invention in affording a designer with maximum flexibility as to the appearance of the dryer and cartridge.

Figure 16:
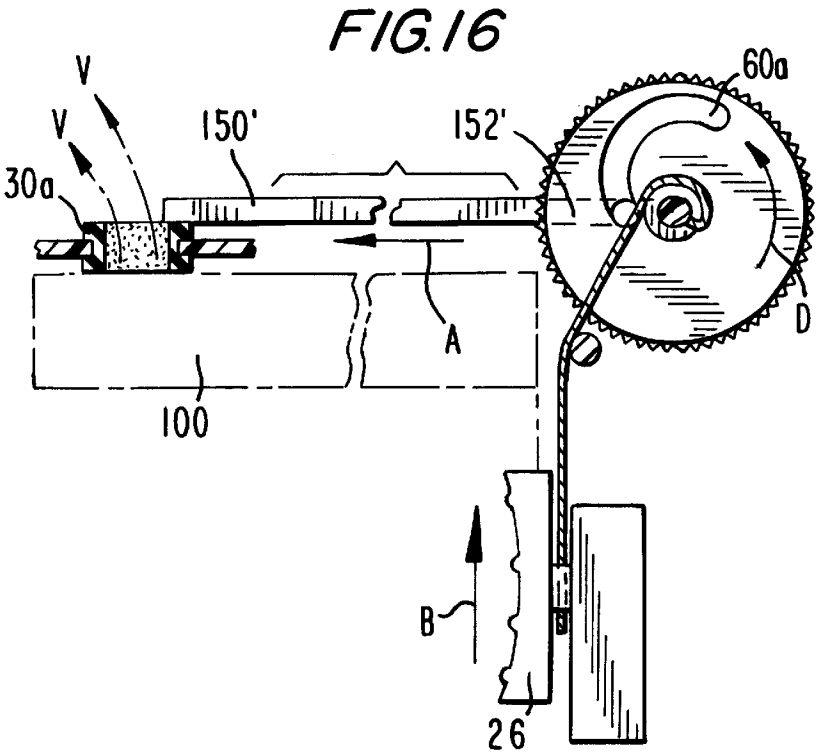
FIG. 16 shows a full-open position an alternate valve control mechanism, can assume when the hair dryer is in use.
Figure 17:
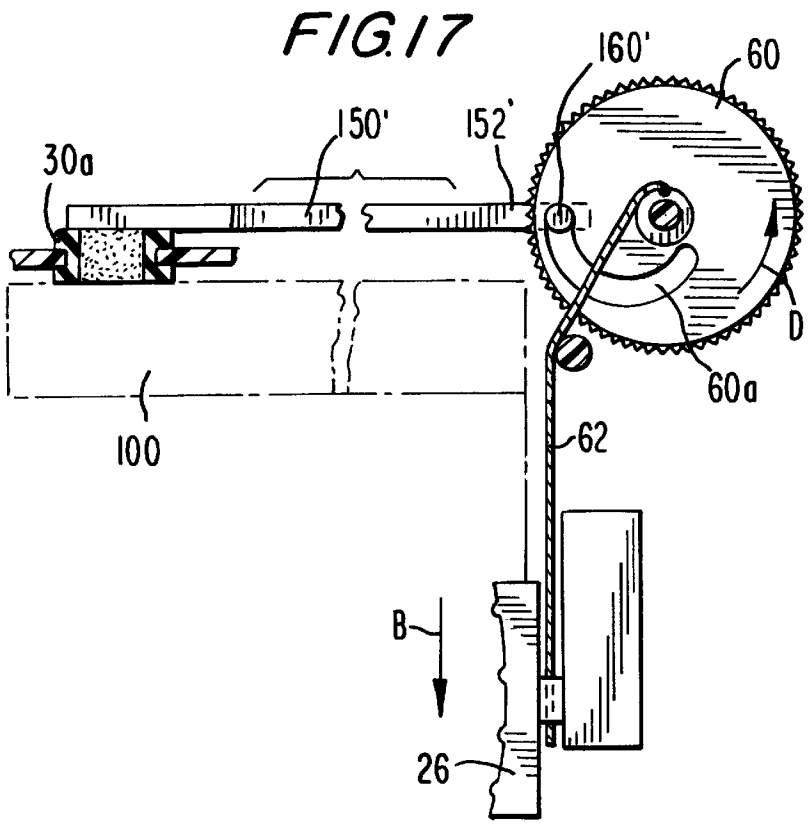
FIG. 17 depicts an automatic shut-off feature provided by the valve control mechanism shown in FIG. 16.

FIGS. 16 and 17 depict an alternate manner of providing an automatic positive close for the regulating valve; as before, features in FIGS. 16 and 17 that correspond to features in previous embodiments, either by general function or configuration, are denoted with a prime (').The regulating valve in the present embodiment is slightly altered to assume the form of a valve 150', having a camming post 160' extending from the edge of the valve transversely to the direction in which it moves. The camming post 160' cooperates with a camming actuator wheel 60 mounted to the hair dryer for rotation. The wheel 60 includes an arc-shaped cutout 60*a* that accepts the camming post 160', so that rotation of the wheel 60 causes sliding movement of the valve 150' in the slider guides 32 and 34 (see FIGS. 3 and 7). The camming wheel 60 is mounted near the inlet end of the dryer duct and a portion of the edge of the wheel extends outside the hair dryer in a fashion similar to that shown in FIG. 2. That is, the camming wheel 60 has a knurled edged, a portion of which protrudes from the hair dryer at a suitable location near the duct inlet, to permit the user of the hair dryer to manually rotate the wheel 60 in a fashion similar to the manner in which the actuator wheel 36 is rotated by the user in the embodiment described above. A cord 62 is connected between the power switch 26 and the axle of the wheel 60. The cord will wrap and unwrap around the axle as the wheel turns.

In operation, the user moves the power switch 26 upward in the direction of arrow B in FIG. 16. If the valve 150' is in the position shown in FIG. 16, the cord 62 will be slack and the user may turn the wheel 60 in the direction of arrow D. That in turn will cause the valve 150' to move in the direction of the arrow A. While using the hair dryer, the user may turn the wheel 60 and move the valve 150' to introduce into the dryer air stream more or less of the substance in the cartridge 100, as discussed above. When the user turns off the hair dryer, by moving the switch downward in the direction of arrow B as shown in FIG. 17 (see FIG. 8 also), the cord 62 will cause the wheel to rotate in the direction of arrow D, thus automatically closing the aperture 30 in the hair dryer duct and sealing the cartridge, in the fashion discussed above in connection with other embodiments.

It will be appreciated that describing the invention as embodied in a hair dryer is not intended to suggest that it is so limited in its application. For example, it can be incorporated in a hair brush that directs air toward a user's head to aid in styling and drying while the hair is being brushed. Those skilled in the art will also recognize that the invention may be applied to such diverse apparatus as a heat gun for transporting wax onto a surface, a garden hose that adds fertilizer or other substances to a water stream, or a wall mounted hand dryer that adds a substance, such as a moisturizer, to the drying stream, just to name a few. It can also be used to add disinfectants, anti-allergy medications, or other substances to a vacuum cleaner or air conditioner. In any of the diverse applications of the invention, and particularly in ventilation systems or bathroom deodorizers, the valve controlling the introduction of the substance to the airstream can be controlled by a timer. Applications in more advanced technologies are also possible, whereby the substance is introduced into the fluid being impelled as a liquid, gas, plasma, or combination of any of these. Moreover, as that implies, evaporation and subsequent diffusion into the impelled fluid stream is not the only manner of introducing the substance into the fluid. Such introduction can also occur by way of aerosolization, for example.

It will be further appreciated that the configurations thus depicted are in the nature of exemplary embodiments. For example, the substance need not be held in a self-contained cartridge, like those described above. And the substance can be disposed wholly or partially disposed inside the duct. Moreover, the structure holding the substance need not be removably mounted to the hair dryer. In fact, the versatility afforded by the invention in its application in various forms is one of its principle advantages. The cartridge also need not be mounted on the bottom of the hair dryer duct, as depicted above.

Figure 18:
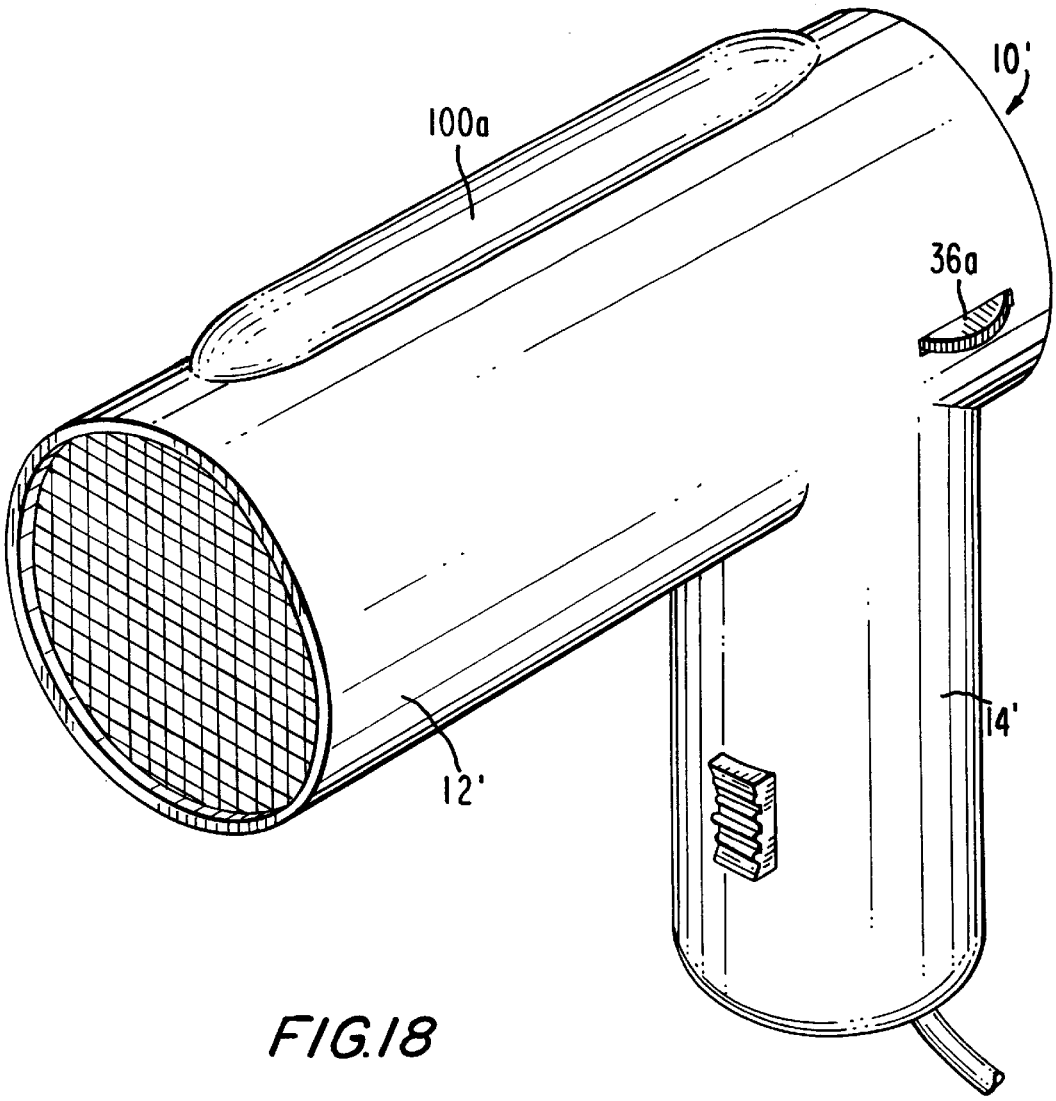
FIG. 18 is a perspective view of another embodiment of the invention involving a cartridge containing the substance to be introduced into the hair dryer air stream mounted on top of the hair dryer.

FIG. 18 illustrates an alternate configuration that further demonstrates the versatility of the present invention. A containing member 100*a* is mounted on the top of the duct 12' of a hair dryer 10'. An actuating wheel 36*a* mounted proximate to the hair dryer handle 14' is linked to a suitable valving device (not shown) to regulate introduction of the substance into the hair dryer air stream. In addition, the substance can be indirectly introduced into the hair dryer air stream through a baffle system (not shown) provided in the interior of the hair dryer duct, to ensure against contact of the substance with the hair dryer heating elements and more evenly distribute the substance throughout the air stream.

Figure 19:
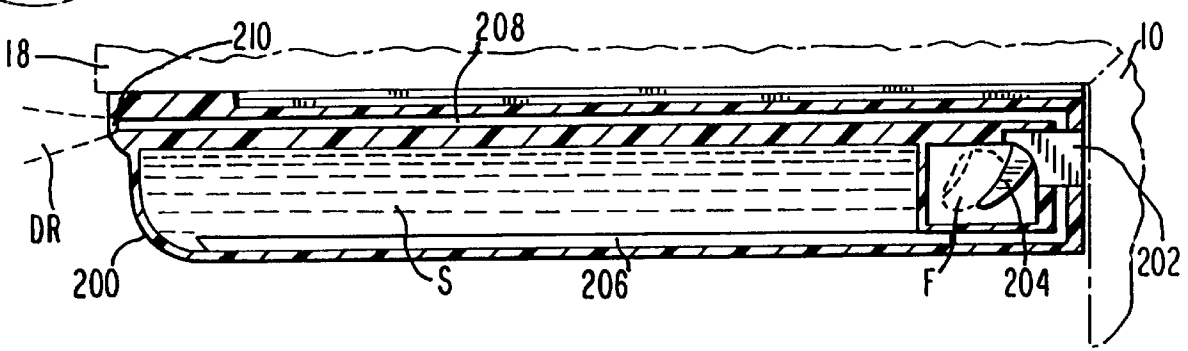
FIG. 19 depicts a cartridge for a hair dryer in accordance with a second aspect of the present invention, in which a substance is applied directly to the hair of the user.
Figure 12:
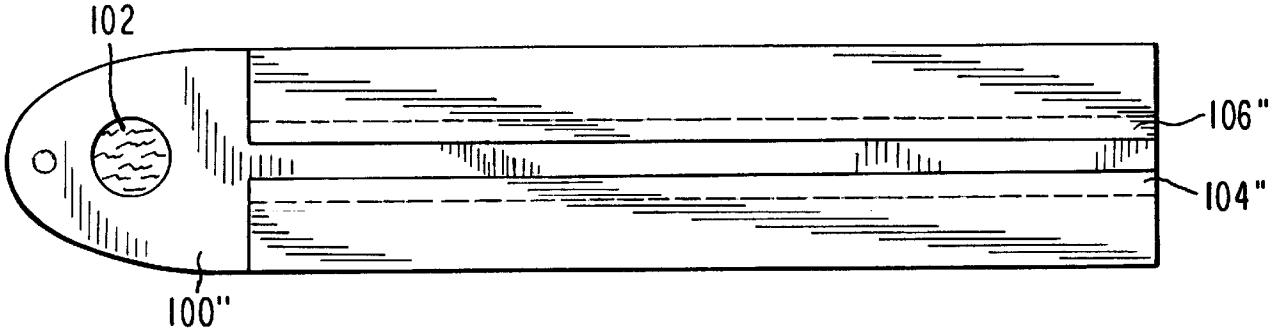
FIG. 12, when taken with FIGS. 13 to 15, depicts a third embodiment of the cartridge, with FIG. 12 being a top view of the present embodiment.
Figure 13:
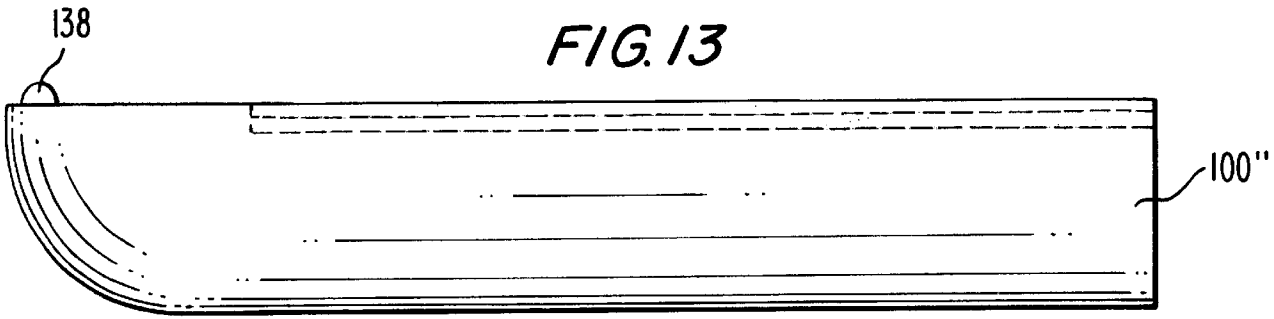
FIG. 13 is a side view of the third cartridge embodiment.
Figure 15:
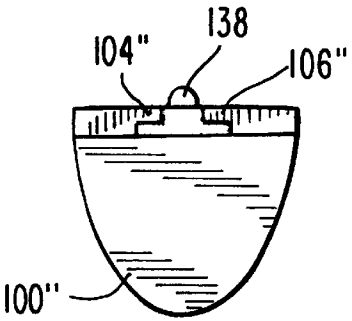
FIG. 15 depicts the rear end of the third cartridge embodiment.
Figure 14:
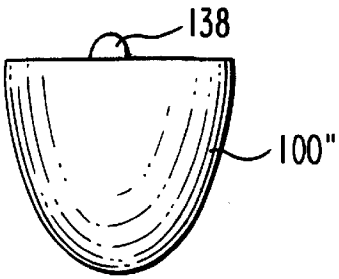
FIG. 14 depicts the front end of the third cartridge embodiment.

FIG. 19 depicts a cartridge 200 in accordance with another aspect of the invention. The cartridge 200 does not introduce the liquid substance into the hair dryer air stream within the duct. Instead, it directly applies it to the user's hair as a spray comprising minute droplets DR. Initially, the details of the attachment of the cartridge 200 to the hair dryer are omitted in this description for the sake of simplicity. It will be understood that the cartridge can be fastened to the hair dryer along the lines discussed above, or in any other suitable manner consistent with the present description.

To effect spraying of the droplets on the user's hair, the cartridge 200 includes a conventional pumping mechanism 202 such as that commonly used on spray bottles dispensing liquids such as hair care products, cleaning fluids, and the like. As is conventional, the pumping mechanism 202 is manually actuated by a trigger 204 that causes the pumping mechanism to draw fluid through a supply pipe 206. In this case, the supply pipe is disposed along the bottom of the cartridge 200 so that it will draw the liquid substance S into the pumping mechanism. In turn, the pumping mechanism 202 provides the liquid under pressure to an exit tube 208 that extends along the cartridge along the top thereof. The exit tube 208 terminates in a nozzle 210 disposed proximate to the duct outlet 18. The nozzle is configured to atomize the liquid supplied to it under pressure, thus forming the droplet spray DR, and direct it onto the user's hair. This cartridge can also include a reclosable fill port (not shown) as discussed above to replenish the substance in the cartridge.

To apply the liquid substance to his or her hair, the user simply inserts a finger F into a recess where the trigger 204 is disposed and squeezes the trigger to eject the spray. The hair dryer is preferably configured so that the user can keep a finger in the recess while using the hair dryer and then dispense the substance S whenever desired. This embodiment is particularly useful for substances such as conditioners, since it may be desired to apply to the hair more of such substances than can be made available through diffusion into the hair dryer air stream.

Figure 20:
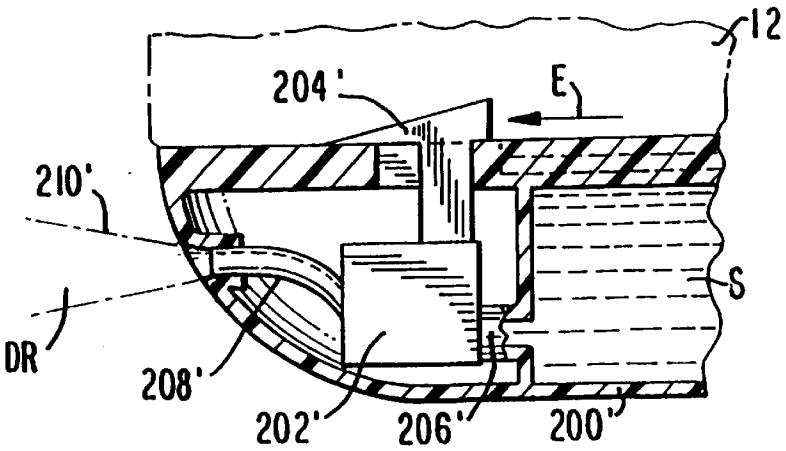
FIG. 20 is a variation of the embodiment shown in FIG. 19.

FIG. 20 is an alternate embodiment of the aspect of the invention represented by FIG. 19. In FIG. 20, as above, features that correspond to features in previous embodiments, either by general function or configuration, are denoted with a prime (′). In this embodiment, a pump actuator 204′ extends through the aperture in the wall of the hair dryer duct 12. The pump actuator can be moved in the direction of the arrow E to dispense the substance S by a suitable mechanism incorporated into the hair dryer. However, it is a particularly advantageous feature of this embodiment that it can be used with a hair dryer having a valve along the lines of the valve 150 shown in FIG. 3. That is, with a hair dryer according to that embodiment of the invention, the cartridge 200′ can be substituted for the cartridge 100 and the pump 202′ actuated by moving the actuating wheel 36. Those skilled in the art will recognize that certain modifications will be required to adapt the hair dryer to the interchangeable use of a diffusion cartridge such as cartridge 100 and pump cartridges like cartridge 200 or 200′. However, those modifications are well within the ken of an industrial designer of ordinary skill and need not be described in detail here.

It will be appreciated that with the configurations illustrated in FIG. 3 and FIG. 20, opening the aperture 30 will require rotation of the wheel 36 in one direction, while ejecting the spray DR will require rotation of the wheel in the opposite direction. It is possible to avoid that inconvenience by slightly changing the configuration of the sealing portion 154 of the valve 150 to provide the sealing portion with an aperture having approximately the same size as the aperture 30 in the hair dryer duct, but spaced from the proximal end of the sealing portion by a distance also approximately the size of the aperture 30. Thus, when the valve 150 is in the position shown in FIG. 9, it would seal the aperture 30 as discussed above. However, to expose the contents of the cartridge to the inside of the duct, the valve would be moved in the direction of the arrow A in FIG. 9 to bring the aperture in the sealing portion 154 into alignment with the aperture 30 in the hair dryer duct. Accordingly, exposing the air stream to the contents of the cartridge through the aperture 30, and actuating the pump mechanism 202′, would involve moving the wheel 36 in the same direction.

While preferred embodiments of the invention have been depicted and described, it will be understood that various changes and modifications can be made other than those specifically mentioned above without departing from the spirit and scope of the invention, which is defined solely by the claims that follow.

What is claimed is:

1. A hair dryer comprising:

a duct with an air outlet;

an impeller for propelling air internally through said duct to exit therefrom at said outlet;

a heating element in said duct for heating the air propelled therethrough;

a containing member mounted to said duct to position a diffusible substance for fluid communication internally of said duct through an aperture in said duct; and a valve movable between an open position for placing the substance in fluid communication with the air in said duct through said aperture to permit introduction of the substance into the air by diffusion and a closed position for sealing said aperture.

2. A hair dryer as in claim 1, wherein said valve in said closed position seals the substance from ambient atmosphere.

3. A hair dryer as in claim 2, wherein said valve is mounted to said duct for sliding movement of a sealing portion between a closed position covering said aperture and an open position uncovering said aperture.

4. A hair dryer as in claim 3, wherein said valve has at least one intermediate position for placing less of said aperture in fluid communication with the fluid in said duct than when said valve is in said open position.

5. A hair dryer as in claim 3, wherein said containing member includes a self-contained cartridge mounted to said duct.

6. A hair dryer as in claim 5, wherein said cartridge includes an opening in substantially fluid-tight sealing engagement with said aperture, whereby said sliding member in said closed position seals said opening.

7. A hair dryer as in claim 6, wherein said cartridge includes a fastener for removably attaching said cartridge externally of said duct.

8. A hair dryer as in claim 1, wherein the substance is liquid and is held by a porous wicking member proximate to said aperture for diffusion into the air in said duct.

9. A hair dryer as in claim 8, wherein the substance is one of a perfume and a conditioner.

10. A blow dryer comprising:

a duct having an air outlet;

an impeller for propelling air internally through said duct to exit therefrom at said outlet;

a heating element in said duct for heating the air propelled therethrough;

a container for holding a diffusible substance, said container being constructed for mounting to said duct with the substance positioned for fluid communication internally of said duct through an opening in said container; and a valve movable between an open position for placing said opening in fluid communication with the air in said duct to permit introduction of the substance into the air by diffusion through said opening and a closed position for sealing said opening.

11. A blow dryer as in claim 10, wherein said container comprises a self-contained cartridge including a fastener for removably mounting said cartridge externally of said duct.

12. A blow dryer as in claim 11, wherein said duct includes an aperture in fluid tight sealing engagement with said opening when said cartridge is mounted to said duct, and said valve includes a sealing portion mounted for sliding movement between a closed position covering said aperture and thereby sealing said opening, and an open position uncovering said aperture.

13. A blow dryer as in claim 12, wherein said sealing portion has at least one intermediate position for partially uncovering said aperture.

14. A blow dryer as in claim 13, further comprising a mechanism for automatically placing said sealing portion in said closed position when a user places a power switch of said blow dryer in an OFF position.

15. A blow dryer as in claim 14, further comprising a controlling mechanism for permitting a user to manually select a position of said sealing member when said power switch is in an ON position.

16. A blow dryer as in claim 15, wherein said controlling mechanism includes an actuator wheel exposed externally of said blow dryer and including gear teeth meshing with a rack gear on said valve for sliding said sealing portion when the user rotates said actuator wheel.

17. A blow dryer as in claim 15, wherein said controlling mechanism includes an actuator wheel exposed externally of said blow dryer and including a camming slot accepting a camming post on said valve for sliding said sealing portion when the user rotates said actuator wheel.

18. A blow dryer as in claim 10, wherein the substance is liquid and is held by a porous wicking member proximate to said opening for diffusion into the air in said duct.

19. A blow dryer as in claim 18, wherein said container includes a fill port for replenishing the substance.

* * * * *